US005803209A

United States Patent [19]

Suzaki

[11] Patent Number: 5,803,209

[45] Date of Patent: Sep. 8, 1998

[54] ADJUSTABLE ROPE TENSIONER

[76] Inventor: Kiyoshi Suzaki, 1137 El Medio Ave., Pacific Palisades, Calif. 90272

[21] Appl. No.: 548,877

[22] Filed: Oct. 26, 1995

[51] Int. Cl.[6] ..... B65H 59/16; A63B 21/018

[52] U.S. Cl. ..... 188/65.2; 482/120; 182/5; 182/191

[58] Field of Search ..... 188/65.1–65.5; 182/5–9, 191–193; 24/132 WL, 134 R, 134 KB, 115 F; 482/120

[56] References Cited

U.S. PATENT DOCUMENTS

| | | | |
|---|---|---|---|
| 295,203 | 3/1884 | Scholl | 188/65.4 |
| 785,019 | 3/1905 | Parker | 188/65.4 |
| 3,022,856 | 2/1962 | Galeano | 188/65.4 |
| 3,217,840 | 11/1965 | Holkesvick | 482/126 |
| 3,510,132 | 5/1970 | Holkesvick | 482/126 |
| 3,608,900 | 9/1971 | Welch | 482/120 |
| 3,757,961 | 9/1973 | Hobbs | 188/65.4 |
| 4,311,218 | 1/1982 | Steffen | 188/65.4 |
| 4,343,466 | 8/1982 | Evans | 482/120 |
| 4,560,160 | 12/1985 | Smith | 482/120 |
| 4,678,659 | 7/1987 | Bowker | 182/5 |
| 5,038,888 | 8/1991 | Varner et al. | 182/5 |
| 5,352,172 | 10/1994 | Suzaki | 182/5 |

*Primary Examiner*—Chris Schwartz
*Attorney, Agent, or Firm*—William H. Maxwell

[57] ABSTRACT

A motion restricting device restraining rectilinear movement of the ends of a rope and comprised of a post with retainment rings passing the rope at one or both opposite ends of the post, and having at least one and preferably a plurality of radially projecting adjustment bits intermediate the ends of the post for hooked engagement of a section of the rope drawn circumferentially around the post, the post and rings and bits being integrally formed and smooth surfaced for controlled frictional engagement with said rope.

5 Claims, 4 Drawing Sheets

R1
P
R2
B
10
a
c
b
11

A
R1
12
13
8
8
P
B
d
9
9
c
R
R2
14
13
10
10
12
a
b

R
a
R1
P
b a
d
B
d
b
P b
R2
a
R

ADJUSTABLE ROPE TENSIONER

BACKGROUND OF THE INVENTION:

This invention relates to rope tensioners used for a wide variety of purposes to yield to pulling force applied to a rope or line. It is an object of this invention to provide rectilinear straight line motion linearly through the tensioner or to and from the tensioner as may be required. The purpose and/or end use of this adjustable rope tensioner is to control the amount of force required to slide the rope therethrough, to thereby retard linear movement of the rope. For example, any situation that requires restraint by means of rope tie-downs and the like, or securement by means of ropes, training devices for athletics and exercise and the like, can usefully employ the adjustable tensioner herein disclosed. A feature and primary object herein is the adjustment and control thereby of the amount of force that the tensioner yields to, it being an object to vary the yield point to force applied.

Characteristically, prior art rope tensioners are complex and difficult to implement because the wrapping and entrainment of the ropes has been intricate and difficult to implement, it being a general object of this invention to greatly simplify rope tensioning by eliminating multiplicity and redundancy and by employing the fewest number of effective members and parts.

Physical exercise involves the application of muscular force, and to this end exercisers have been devised in the form of rope tensioners that yield under tension to muscular force applied by various parts of the human anatomy. For example, forceful body movements of the arms, legs, torso and head are applied to rope under tension, the rope being frictionally restrained so as to yield to forceful movements of the person's body parts. Accordingly, exercise devices of the type under consideration are characterized by restraining tensioners about which a rope is wrapped or entrained to frictionally slide in response to rectilinear motion.

This invention relates to a rope tensioner that involves a length of rope engaged over or through a motion restricting device, in order to yield to tension applied from either opposite end of the rope. There are several types of such motion restricting devices; a basic form wherein the loop of rope is spirally wrapped upon itself, as in the Welch U.S. Pat. No. 3,608,900 issued Sep. 28, 1971; a form wherein the loop of rope is spirally wrapped over a friction member, as in the Smith U.S. Pat. No. 4,560,160 issued Dec. 24, 1985; another form wherein each leg of the loop of rope is spirally wrapped over an individual friction member, as in the Evans U.S. Pat. No. 4,343,466 issued Aug. 10, 1982; still another form wherein the rope is entrained in a serpentine manner over and under a multiplicity of cross bars, as in the Steffen U.S. Pat. No. 4,311,218 issued Jan. 19, 1982. And, there is the Rope Exerciser patent to Suzaki U.S. Pat. No. 5,352,172 issued Oct. 4, 1994 wherein parallel side members each carry a plurality of bars over which opposite legs of a rope loop are entrained in a serpentine manner.

Variation in frictional engagement is attained by the prior art in the manner of wrapping and entrainment around post-like members and bars, over and around which the rope slides when tension forces are applied. As taught by the prior art, the manner of wrapping is complicated and tedious,it being an object of this invention to eliminate complication, to reduce tedium, and to simplify the selection of restraint, whereby tension can be adjusted readily with predetermined results. With this present invention, a plurality of friction posts are eliminated, the multiplicity of friction bars are eliminated, and all of which is replaced by a monolith friction post over which a length of rope lies, and frictional restraint adjusted by means of a simple cross of bit members intermediate the opposite ends of the post where the length of rope is trained through captive rings through which the rope frictionally slides.

The rope exerciser herein disclosed is characterized by a single friction post and intermediate variable friction cross bit members over which a section of the rope is selectively hooked. In practice, the section of rope has at least five distinct force restrictive positions; a first position in which the rope passes by the cross member and only extends frictionally through the opposite end rings; a second position in which the rope forms a shallow bite over a nearest one of four bit members; a third positioning which the rope forms an increased bite over the second of said bit members; a fourth position in which the rope forms a further increased bite over the third of said bit members; and a fifth position in which the rope forms a maximum bite over the fourth of said bit members.

It will be observed that there is at least one and preferably a plurality of said bit members. For example, two or three or more bit members and preferably a cross of right-angularly disposed bit members projecting radially from the axis of the post member, each successive bit member being positioned 90° in advance of a preceeding position thereof. A section of the rope can be entrained as above described, in any combination of the aforesaid positions, thereby providing a multiplicity of variations.

A feature of this adjustable rope tensioner is its ability to control rope tension rectilinearly through the device in a straight line or rectilinearly to and from the device in straight lines. In the latter adaptation the straight lines of rope under tension can be parallel or divergent as circumstances require. Another feature of this adjustable tensioner is that either end of the rope can fall loosely, while an active end can be under tension.

SUMMARY OF THE INVENTION

This Adjustable Rope Tensioner is a pull device, and is employed by securing it to a fixed object or to an object to be controlled with respect to forces applied. Opposite end rings pass the length of rope to which pulling force is applied.

Referring to FIG. 1, a basic rope tensioning adjustment is shown wherein a loose end of the rope is entrained upwardly through the anchored end ring and frictionally turned thereby into the direction of pull and hooked over the bit of a cross thereof (see FIG. 5), and then entrained downwardly through the opposite free end ring to emanate in the straight line of pull, there being four bit adjustment positions.

Referring to FIG. 2, rectilinear force can be applied to either or both ends of the rope, in parallel or divergent directions as may be required. As shown, opposite ends of the rope are entrained through the opposite end rings of the tensioner fixedly supported so that pulling forces can be applied to either ring. A center section of the rope is turned from either direction of pull through said spaced end rings and hooked over one of the bits of cross, there being four bit adjustment positions (see FIG. 5).

Referring to FIG. 3, rectilinear force is adjustably employed as it is basically shown in FIG. 1, except that the force is applied to the tensioner per se rather than to the rope. Accordingly, one end of the rope is fixed while the other end of the rope is loose and free, force being applied to the tensioner in alignment with the fixed end of the rope, for example in a fire escapement apparatus for descent of a person from a height.

Referring to FIG. 6, a loop of rope is entrained downwardly through the free end ring, then upwardly through the anchored end ring, and then downwardly again through the free end ring (see FIG. 7). Accordingly, one leg of the rope loop emanates upwardly through the free end ring while the other leg of the rope loop emanates downwardly through the free end ring. As shown, the two legs of the rope loop are initially parallel with each other at opposite sides of the post member, which is the first position shown in FIG. 7. Successively tighter positioning of the rope loop is shown in FIGS. 11, 13, 15 and 17, as will be described.

The foregoing and various other objects and features of this invention will be apparent and fully understood from the following detailed description of the typical preferred forms and applications thereof, throughout which description reference is made to the accompanying drawings.

THE DRAWINGS

Figure 7:
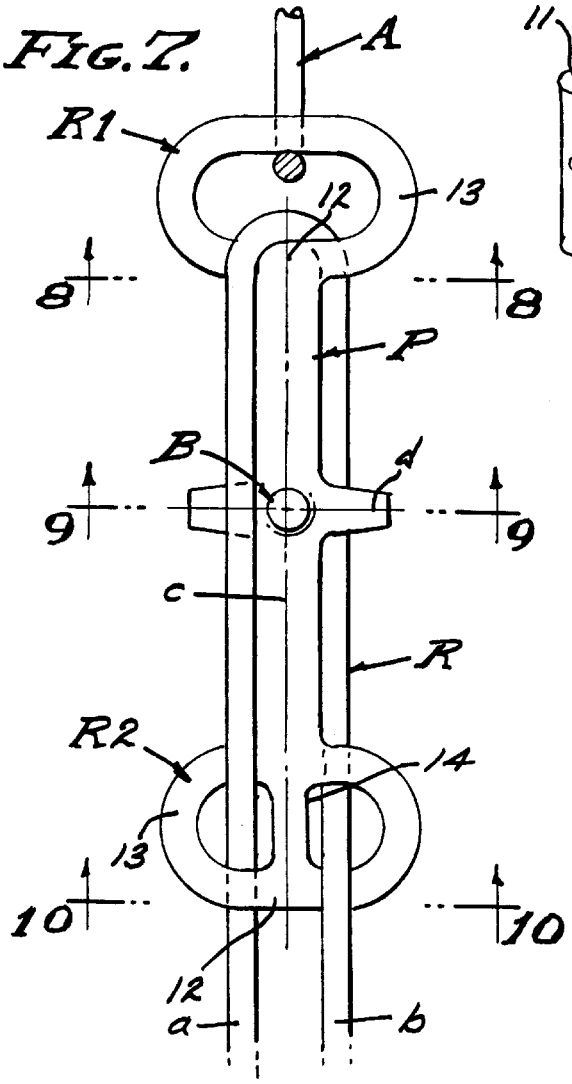
Figure 8:
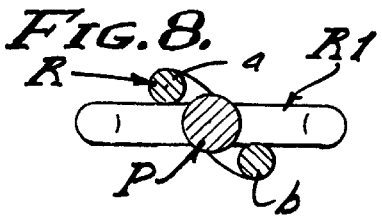
Figure 9:
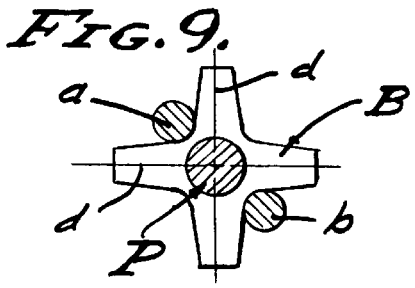
Figure 10:
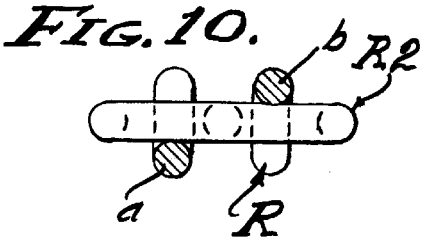

FIG. 7 is an enlarged plan view of the tensioner with a rope entrained in a first working position, FIGS. 8, 9 and 10 are sectional views taken as indicated by line 8—8, 9—9 and 10—10 on FIG. 7.

Figure 11:
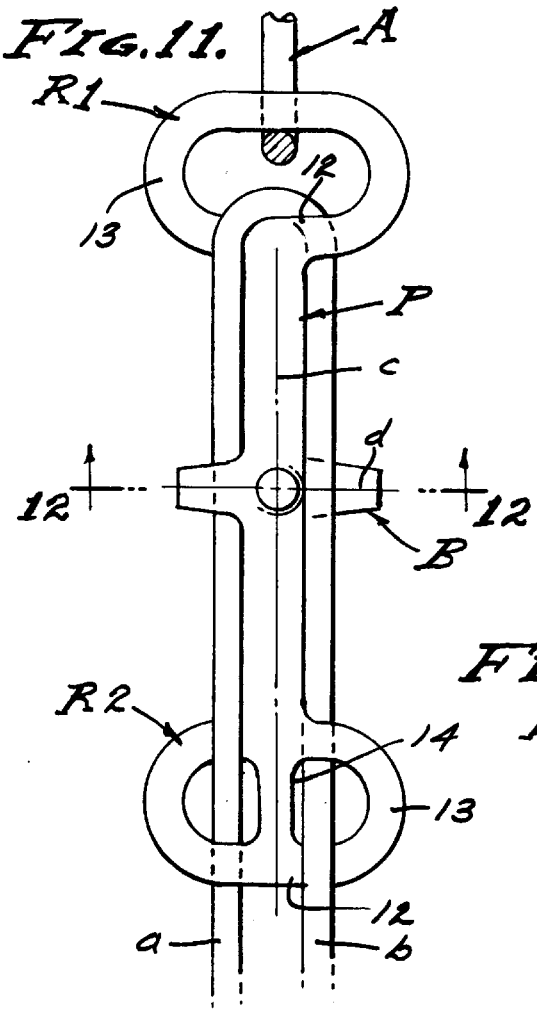
Figure 12:
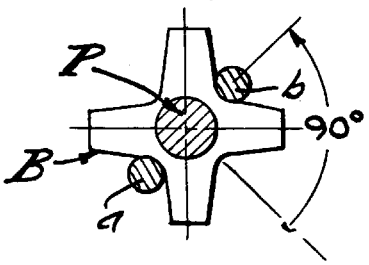

FIGS. 11 and 12 illustrate a rope entrained in a second working position, FIG. 11 being a view similar to FIG. 7 and FIG. 12 being a view taken as indicated by line 12—12 on FIG. 11.

Figure 13:
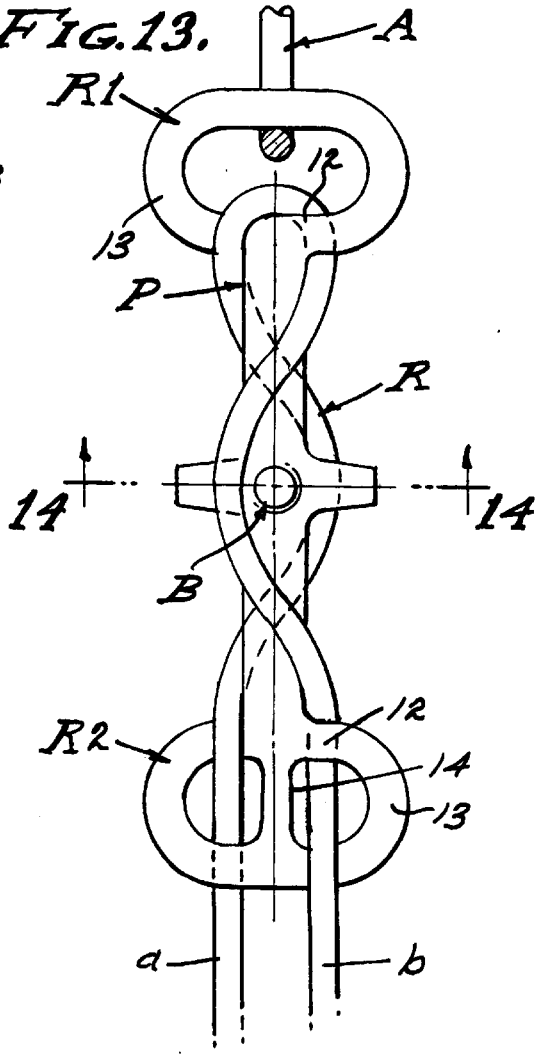
Figure 14:
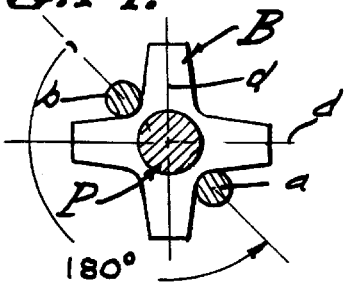

FIGS. 13 and 14 illustrates a rope entrained in a third working position, FIG. 13 being a view similar to FIG. 7 and FIG. 14 being a view taken as indicated by line 14, 14 on FIG. 13.

Figure 15:
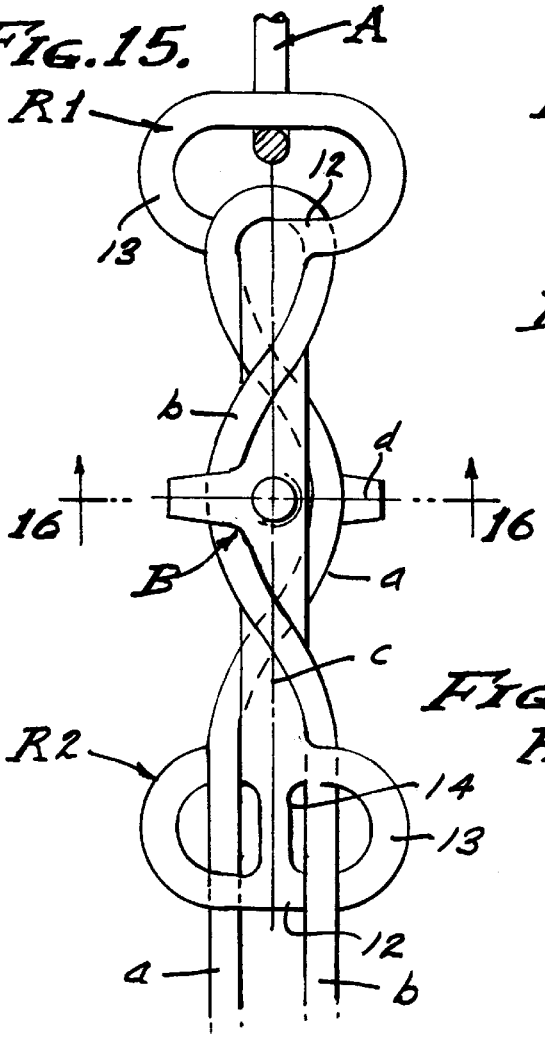
Figure 16:
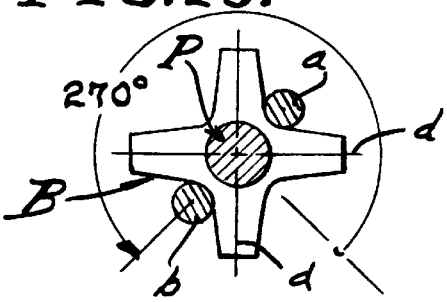

FIGS. 15 and 16 illustrate a rope entrained in a fourth working position, FIG. 15 being a view similar to FIG. 7 and FIG. 16 being a view taken as indicated by line 16—16 on FIG. 15.

Figure 17:
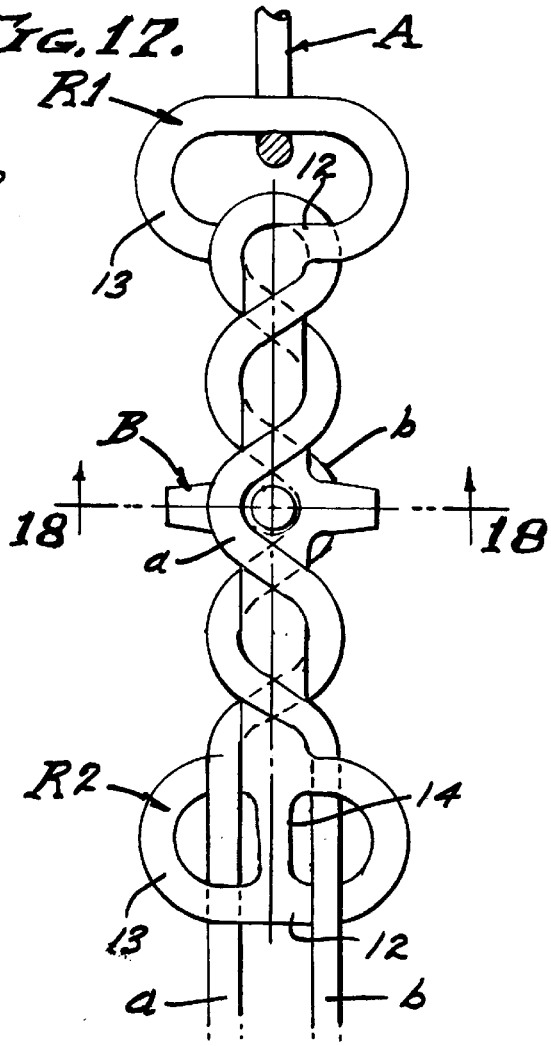
Figure 18:
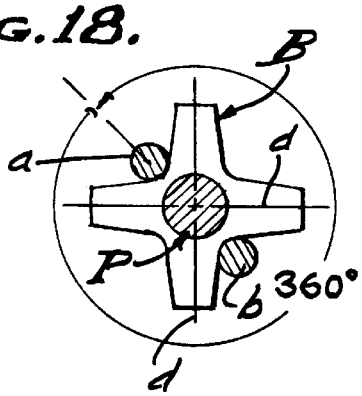

And, FIGS. 17 and 18 illustrate a rope entrained in a fifth working position, FIG. 17 being a view similar to FIG. 7 and FIG. 18 being a view taken as indicated by line 18—18 on FIG. 17.

PREFERRED EMBODIMENT

Figure 1:
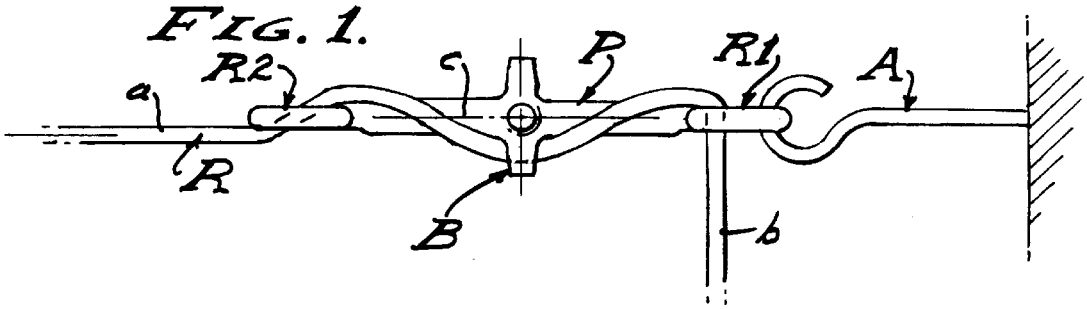
FIG. 1 illustrates rectilinear rope tensioner control in alignment with the opposite end rings of the device.

Referring now to the drawings, FIG. 1 illustrates a typical use of this Adjustable Rope Tensioner which includes, generally, a single elongated alignment post P, spaced coplanar retainment means R1 and R2 carried on the axis of and projecting from opposite ends of the post, and at least one and preferably a plurality of bit members B projecting radially from the post at a position intermediate said retainment means at opposite ends of the post, for tension adjustment of the rope as circumstances require. It is an object of this invention to adjust the frictional restraint to rectilinear movement of a rope R, whereby a length of rope having opposite legs a and b can be frictionally restrained against movement as may be required.

As shown in FIG. 1, the leg a of rope R is rectilinearly disposed in straight alignment with the axis c of the tensioner post P, while the leg b drops loosely as it is essentially inactive in this embodiment. In practice, the fixed ring R1 is secured by a hook of the anchor means A. As shown, the loose leg b of rope R is entrained upwardly through the retainment ring R1, and downwardly through the retainment ring R2 to project axially from and along the axis c of the alignment post P. A center section of the rope R is circumferentially hooked around the post P and over a bit member B, shown in FIG. 1 as a third position of adjustment on the second bit member removed from the top of the device.

Figure 2:
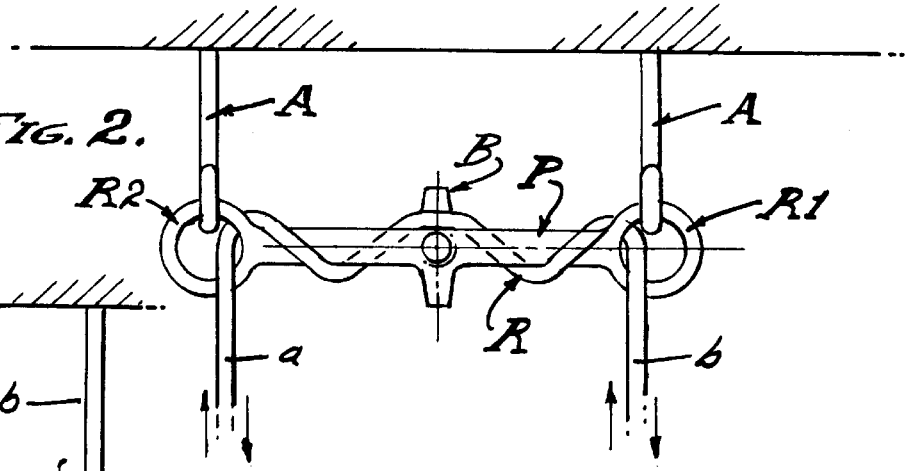
FIG. 2 illustrates rectilinear rope tensioner control from the opposite end rings of the device.

As shown in FIG. 2, the opposite legs a and b of rope R are each rectilinearly disposed as they extend in straight lines from each ring R1 and R2 respectively. Axes of legs a and b are right angularly related to the post axis c in this embodiment, and they can be other than parallel. In practice, the rings R1 and R2 are secured by hooks of the anchor means A. As shown, the legs a and b are entrained through one side of the coplanar rings R1 and R2, and a center section of the rope R is circumferentially hooked around the post P and over a bit member B, shown in FIG. 2 as a fifth position of adjustment on the fourth bit removed from the back sides of the rings (as shown in FIG. 2).

Figure 3:
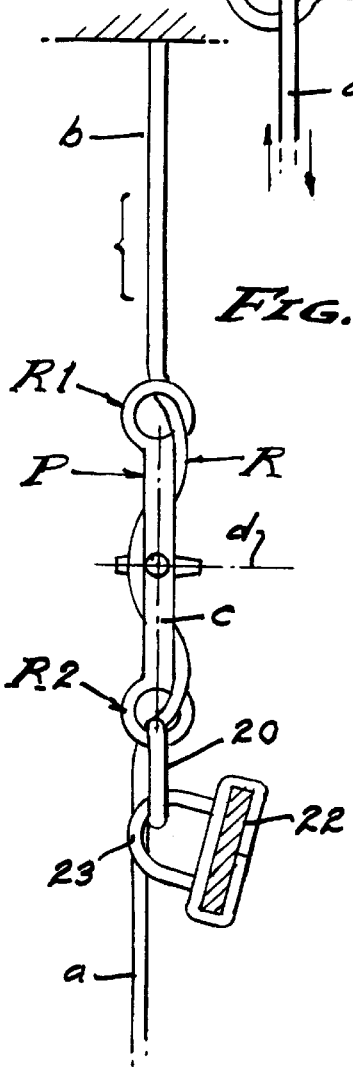
FIG. 3 illustrates rectilinear rope tensioner control of force applied to the device.

As shown in FIG. 3, the anchored leg b of rope R is rectilinearly disposed in a straight line aligned with the axis c of the tensioner post P, while the leg a loosely falls away in alignment with the rectilinear axis c. The adjustment shown is the same as in FIG. 1 but the pulling force is applied to the alignment post P by means of a link 20 coupled through an eye 21 to a belt or harness 22 as for embracing a person to be lowered to safety from an elevated hazard or the like.

Figure 4:
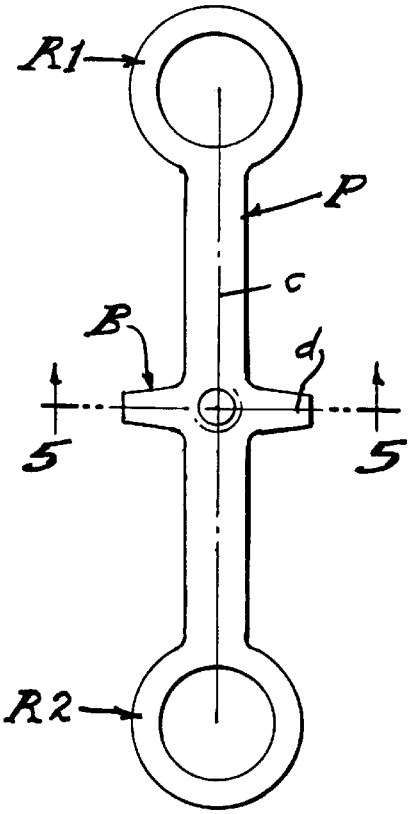
FIG. 4 is an enlarged view of the Adjustable Rope Tensioner apart from the rope that it controls.
Figure 5:
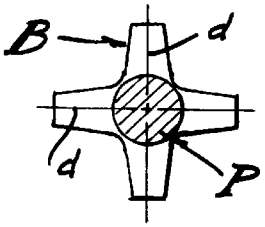
FIG. 5 is a sectional view taken as indicated by line 5—5 on FIG. 4

FIGS. 4 and 5 illustrate the tensioner as an article of manufacture, comprised of the alignment post P, the opposite end retainment rings R1 and R2, and the plurality of bit members B preferably is cross formation. The device is characteristically a smooth surfaced monolithic structure.

Figure 6:
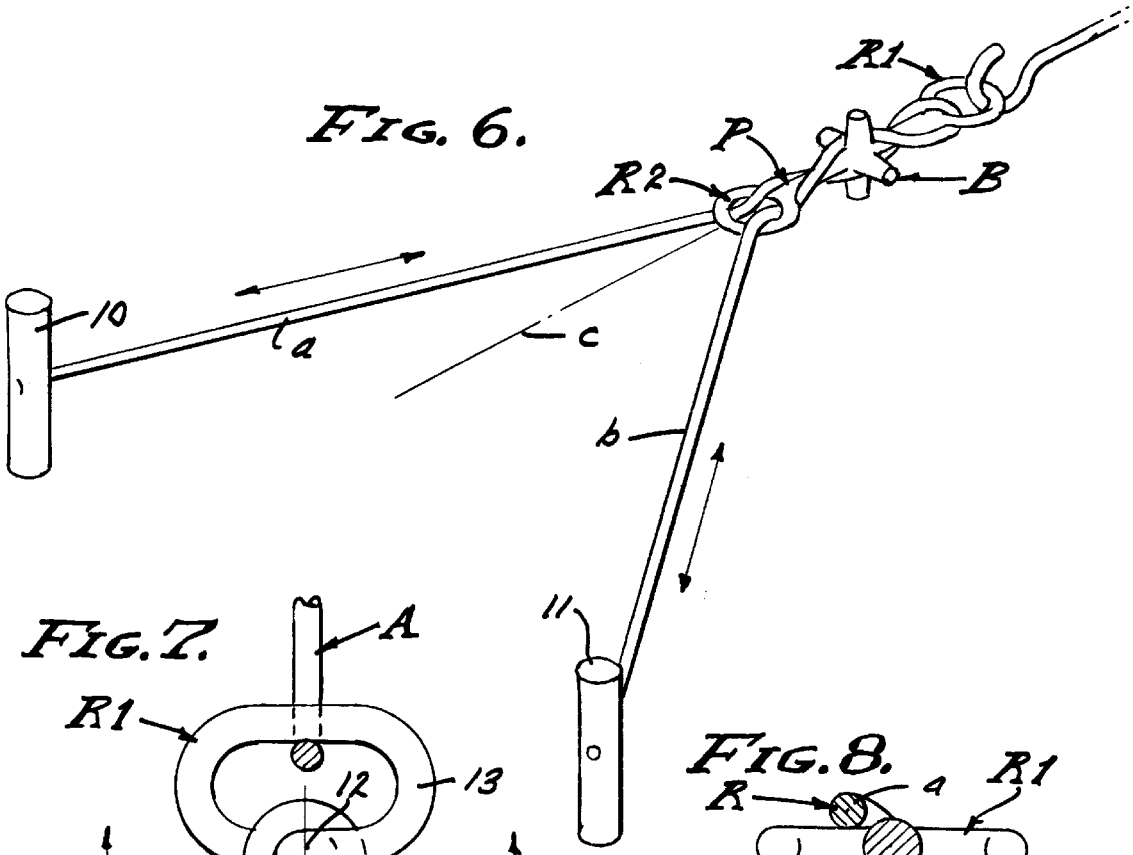
FIG. 6 is a perspective view of the tensioner embodied in an exercising apparatus.

As shown in FIG. 6, it is the exercise of the pectoral girdle (not shown) that is involved, whereby the arms of a person are applied to alternately pull each of opposite legs a and b, by gripping handles 10 and 11 at the opposite bitter ends of the loop of rope R. It is the center intermediate section of rope with which this invention is particularly concerned, reference being made to FIG. 6 wherein the center section is a loop of the rope R entrained through the aforesaid retainment means R1 and R2, and over members P and B of this rope tensioner device.

The variable tension rope exerciser herein disclosed is an integral device comprised of a plurality of members fabricated of a rigid monolithic body of material having a smooth exterior surface adapted to have frictional engagement with the rope entrained through and wrapped thereover. The integral joinder of members P, B, R1 and R2 is characterized by filleted transition of one member into the other, employing a uniform fillet radius substantially the same as the radius of the rope cross section. Accordingly, the rope R is free to slide from one member to the other without jamming when transition is made around obtuse turns as well as acute turns of the rope. In practice, state of the prior art braded rope or line is employed; for example marine grade line comprised of a longitudinal bundle of highly flexible compactly disposed tension filaments encased in a supple protective sleeve or braid.

The rope tensioner of this exercising device adjustably controls rectilinear movement of the rope R by frictionaly restricting its sliding engagement over the alignment post P and around the bit or bits B. Since pulling forces are externally applied to the device, the alignment post P is anchored by a means A. Pulling forces are applied from either leg a or b, or both, and transferred along pulling axis c of the alignment post P. In FIG. 6 the force along axis c is a vector of the forces applied from the two axes a and b. It is to be understood that a single force applied along either axis a or b could be coincidental with the alignment axis c. Accordingly, the axis c is shiftable to accommodate the pull axis or axes, the anchor means A being a swivel connection or the like, such as the ring or hook as shown. In practice, the fixed hook of anchor means A is engaged through the retainment ring R1 and from which the device swings in omni directions.

The alignment post P is a straight longitudinally disposed body of uniform cross section extending along the axis c between an inner anchor end and an outer free end. The post P is essentially of "bar" configuration and preferably of round cross section about which the rope R can be spirally wrapped for contiguous frictional engagement with the smooth cylindrical exterior of the post. In practice, the diameter of the post P is substantially greater than the diameter of the rope R, for example 1 ½ that of the rope as shown.

The retainment means R1 and R2 are alike and are carried in a common plane coincidental with the alignment post P on axis c by said alignment post. In practice, the hook of anchor means A opens upwardly, in which case the inner retainment means R1 is a toroid ring lying in a normal horizontal transverse plane, so that the integral alignment post P swings upwardly and downwardly on said hook. The outer retainment means R2 is a toroid ring lying in said normal horizontal transverse plane coplanar with ring R1, the planes of both rings being coincidental with axis c and said rings and opening upwardly to pass the rope R that is entrained therethrough as will be described. The rings R1 and R2 are basically toroidal, however it is preferred that they are transversely flattened into semi-eliptical form having straight bar sections 12 between spaced semi-circular sections 13. The sections 12 and 13 are round in cross section and of the same or slightly greater diameter than that of the rope R. The center loop section of rope R is retained in working position by the two rings R1 and R2.

The bit members B are alike and each forms a lateral projection in the nature of a "bollard" about which the rope R can be contiguously warped for frictional engagement. There is at least one bit member B centered on the alignment post P and projecting transversely at a right angle from axis c of the post. In practice, there is at least one bit member B for each of the legs a and b of the loop of rope R, thereby providing at least one tension adjustment for each leg. However and in accordance with this invention, circumferentialy spaced bits B are provided for rope adjustment, and as shown there are four tension adjustments from the initial entrainment of the rope R by providing a "cross" of four bit members B (see FIGS. 9, 12, 14, 16, and 18), there being five adjusted positions for each leg a or b. Accordingly, the four bit members B project radially from axis c on radially disposed right angularly related axes d spaced 90° one from the other and one of said axes lying in the planes of the two retainment rings R1 and R2. As shown, the bit members B are of round cross section of approximately the same or smaller diameter than the alignment post P and slightly tapered to a height greater than the diameter of the rope R. In practice, the bit members B are approximately two times as high as the rope diameter. The center sections of legs a and b are selectively trained over and around the bit members as will now be described.

Referring now to FIGS. 1–3 of the drawings, there are two simple steps for entrainment of the rope R into working position so as to establish a first and initial position providing the least restriction to rectilinear movement of either leg a or b formed thereby. Step one involves passing the bitter end of the rope R through the retainment ring at one end of the alignment post P. Step two involves drawing the bitter end along one side of the alignment post P and passing it through the retainment ring at the other end of the alignment post P. Legs a and b are thereby established and drawn out and away as shown throughout the drawings. The primary frictional restraint is in passing downwardly and upwardly through the retainment rings R1 and/or R2. This primary restraint establishes the least restraint to linear movement of the legs a and b as and when pulling forces are applied to either leg or section thereof.

Referring now to FIGS. 6 and 7 of the drawings, the second step also involves returning the bitter end of the rope R along the other side of the alignment post P and then passing it again through the retainment ring R2 at said one end of the alignment post referred to in step one described in the preceeding paragraph above. Accordingly, legs a and b initially lie alongside the post P as shown in FIG. 7 and emanate from the device at the retainment ring R2, one parallel with the other or divergent as shown in FIG. 6. The center section of the rope R is transferred from one side of the retainment R1 to the other side, and the two legs emanate from opposite sides of the retainment ring R2, as is clearly shown. A feature is a separator in the form of a bar 14 disposed on the axis c and extending between the spaced bar sections 13 of the retainment ring R2. The separator bar 14 prevents interference of one leg a with the other leg b, thereby preventing entanglements.

A third step of entrainment involves drawing the center section of the rope R over a bit member B projecting from a side of the alignment post P, thereby establishing one of several adjusted positions as will now be described:

Referring now to FIGS. 11 and 12 of the drawings, a second adjustment of each leg a and b is shown, wherein said legs are trained around a first angularly displaced bit member B, thereby adding a secondary restraint to the aforesaid primary restraint. By comparing FIGS. 11 and 12 it is apparent that a section of leg b is drawn rotatively 90° and hooked over a bit member B, while a section of the leg a is also drawn rotatively 90° and hooked over a bit member B. Either one or both legs may be drawn over a bit member, thereby providing two incremental adjustments.

Referring now to FIGS. 13 and 14 of the drawings, a third adjustment of each leg a and b is shown, wherein a section of each leg is trained around a second angularly displaced bit member B, thereby adding a secondary restraint greater than that shown in FIG. 11. By comparing FIGS. 13 and 14 it will be seen that the leg a section is drawn spirally 180° and hooked over a bit member B, while the leg b is also drawn spirally 180° and hooked over a bit member B. The loop sections of rope R drawn over the bit members wrap spirally clockwise and then counter clockwise onto the cylindrical exterior of the alignment post P to have frictional engagement therewith. Either one or both leg sections may be drawn over a bit member, thereby providing two incremental adjustments and one leg may be dropped back to the positions shown in FIGS. 9, or 12.

Referring now to FIGS. 15 and 16 of the drawings, a fourth adjustment of each leg a or b is shown, wherein said legs are trained around a third angularly displaced bit member B, thereby adding a secondary restraint still greater than that shown in FIG. 13. By comparing FIGS. 15 and 16 it is apparent that a section of the leg b is drawn spirally 270° and hooked over a bit member B, while a section of the leg a is also drawn spirally 270° and hooked over a bit member B. The loop sections of rope R drawn over the bit members wrap spirally clockwise and counterclockwise onto the cylindrical exterior of the alignment post P to have frictional engagement therewith. Either one or both leg sections may be drawn over a bit member, thereby providing two incremental adjustments and one leg may be dropped back to its positions shown in FIGS. 9, 12 or 14.

Referring now to FIGS. 17 and 18 of the drawings, a fifth adjustment of each leg a and b is shown, wherein said legs are trained around a fourth angularly displaced bit member B, thereby adding a secondary restraint even greater than that shown in FIG. 15. By comparing FIGS. 17 and 18 it is apparent that a section of leg a is drawn spirally 360° and hooked over a bit member B, while a section of leg b is also drawn spirally 360° and hooked over a bit member B. The loop sections of rope R drawn over the bit members wrap spirally clockwise and counterclockwise onto the cylindrical exterior of the alignment post P to have frictional engagement therewith. Either one or both leg section may be drawn over a bit member, thereby providing two incremental adjustments and one leg may be dropped back to the positions shown in FIGS. 9, 12, 14 or 16.

It is to be understood that additional adjustments are attained by providing more bit members B at closer angular intervals, and/or by drawing the center sections or loop of the the rope R more than 360°, there being no exact limit, all as circumstances may require.

Having described only the preferred forms and applications of my invention, I do not wish to be limited or restricted to the specific details herein set forth, but wish to reserve to myself any modifications or variations that may appear to those skilled in the art as set forth within the limits of the following claims.

I claim:

1. A motion restricting device for adjustably restraining rectilinear movement of and in combination with a loop of rope in an exerciser for controlling tension force applied to either of two opposite legs of the rope, and including;

an elongated alignment post disposed along a pulling axis extending from at least one of said legs when tensioned thereby, a rope retainment means in the form of spaced rings centered on and in a common plane coincidental with the pulling axis and projecting from opposite ends of the alignment post for passing the legs of the rope therethrough, a plurality of angularly displaced circumferentially spaced bit members arranged on radially disposed angularly separated axes projecting radially from the alignment post pulling axis at a position intermediate opposite ends of the alignment post for selectively adjusting restrainment of the rope, the alignment post and the retainment means rings and the bit members being smooth surfaced for frictional sliding engagement with said loop of rope, the loop of rope having a center section disposed between said opposite end legs thereof and entrained into and through the retainment means rings at one end of the alignment post to extend along one side thereof and entrained and turned through the retainment means ring at the other end of the alignment post to extend along the other side of the alignment post and through and out of the retainment means ring at said one end of the alignment post, the center section of the rope entrained along either one side or the other of the alignment post being rotatively drawn and hooked over one of the angularly displaced bit members, and the two opposite legs of said loop of rope being tensioned through the retainment means ring at said one end of the alignment post.

2. The adjustable motion restricting device and rope exerciser as set forth in claim 1, wherein the rope initially entrained along either side of the alignment post is rotatively drawn 90° and hooked over a bit member angularly separated 90° from an initial position of the rope.

3. The adjustable motion restricting device and rope exerciser as set forth in claim 1, wherein the rope initially entrained along either side of the alignment post is rotatively drawn 180° and hooked over a bit member angularly separated 180° from an initial position of the rope.

4. The adjustable motion restricting device and rope exerciser as set forth in claim 1, wherein the rope initially entrained along either side of the alignment post is rotatively drawn 270° and hooked over a bit member angularly separated 270° from the initial position of the rope.

5. The adjustable motion restricting device and rope exerciser as set forth in claim 1, wherein the rope initially entrained along either side of the alignment post is rotatively drawn 360° and hooked over a bit member angularly separated 360° from an initial position of the rope.

* * * * *